United States Patent [19]

Lindblade

[11] 4,179,764

[45] Dec. 25, 1979

[54] LIFESAVING DEVICE

[76] Inventor: Roy W. Lindblade, 3349 W. 111th St., Chicago, Ill. 60658

[21] Appl. No.: 876,021

[22] Filed: Feb. 8, 1978

[51] Int. Cl.[2] ..... B63C 9/00

[52] U.S. Cl. ..... 9/14; 114/43; 114/61

[58] Field of Search ..... 280/12 R, 12 S, 12 E, 280/18-20; 9/14, 1.6, 2 A, 2 R; 114/43, 61

[56] References Cited

U.S. PATENT DOCUMENTS

| | | | |
|---|---|---|---|
| 981,360 | 1/1911 | Barney | 9/14 |
| 3,532,066 | 10/1970 | Clemans | 114/43 |
| 3,711,879 | 1/1973 | Siefert | 114/43 |
| 3,794,140 | 2/1974 | Sell | 9/1.6 |
| 3,812,805 | 5/1974 | Forssell | 9/2 A |
| 4,058,862 | 11/1977 | Stevens | 9/14 |
| 4,079,953 | 3/1978 | Howarth | 9/14 |

*Primary Examiner*—Stephen G. Kunin

*Assistant Examiner*—D. W. Keen

*Attorney, Agent, or Firm*—Hill, Van Santen, Steadman, Chiara & Simpson

[57] ABSTRACT

A lifesaving device having a pair of inflatable floatation bags which may be inflated by means of compressed gas and attached to a folding platform to form a device suitable for use over water or on ice or in a combination of water and ice to retrieve a party who has ventured out onto the water or the ice. The lifesaving device being easily transportable by storing the inflatable floatation bags in a non-inflated state within the hinged platform which serves as the deck for rescuers. Having further, a pivoted ladder mounted at one end of the platform so that as the rescued person is approached the ladder may be rotated so that one end of it drops beneath the surface of the water or falls upon the ice and provides apparatus for the rescued party to ascend out of the water onto the platform.

11 Claims, 9 Drawing Figures

Fig. 4
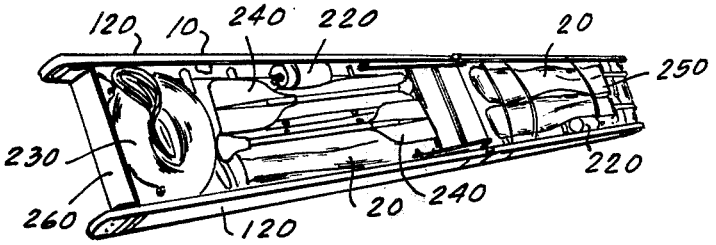
Fig. 5
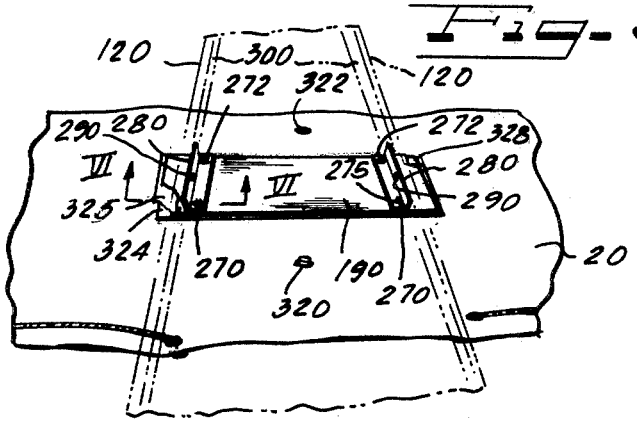
Fig. 6
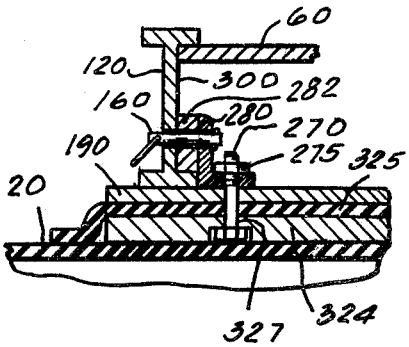
Fig. 7
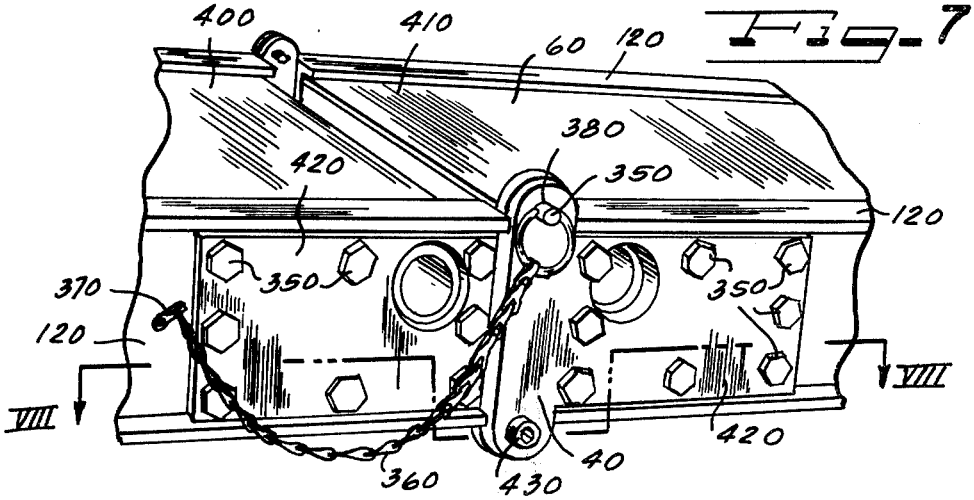
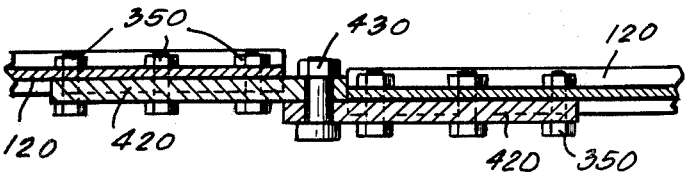
Fig. 8
Fig. 9
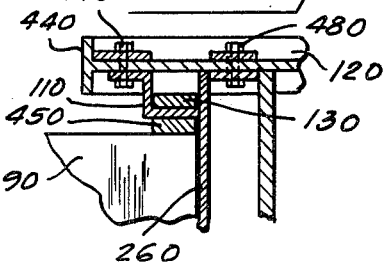

LIFESAVING DEVICE

BACKGROUND OF THE INVENTION

1. Field of the Invention

The field of this invention is lifesaving equipment. More particularly, lifesaving equipment for use on water or on ice where there is a possibility of breaking through the ice if one advances onto it or on broken ice where one is faced with a mixture of ice and water and it is necessary to rescue a person off shore.

2. The Prior Art

The prior art with respect to water or ice rescue equipment includes such devices as life vests, life rings, assorted types of rafts or floatation devices, for rescues in water and typically the use of ladders or other such equipment when it is necessary to cross thin ice to rescue a person.

SUMMARY OF THE INVENTION

This invention is a lifesaving device suitable for use over ice or in water for rescuing a person who has either broken through the ice or has gotten stranded out in open water. The invention consists of inflatable floatation devices made out of reinforced nylon which support a platform between them such that a rescuer might put the floatation devices and the connecting platform into the water or onto the ice, go on to the platform and be supported either above the ice or by floatation above the water by the platform resting on the floatation devices. Further, the invention includes a ladder mounted at one end of the lifesaving platform, rotatable such that one end of the ladder may be dropped into the water or onto the ice so that the person being rescued may climb up onto the ladder and stand on a small safety platform, affixed to the ladder, which is either on the ice or under the water at that particular time. Upon retrieving the rescued party from the water or the ice, the rescue unit is then pulled back to shore by ropes or by a ladder hooked onto it, or paddled back or motored back using a small motor. The invention is highly portable collapsing into a small nine-foot section, into which is stored the deflated floatation devices and the lifesaving equipment set is easily transported by two persons and then set upon on site. The floatation devices being inflated by compressed gas before being affixed to the platform which is then placed in the water or onto the ice.

BRIEF DESCRIPTION OF THE DRAWINGS

FIG. 4 is a view of the rescue apparatus before it is set up but after it has been unfolded.

FIG. 5 is a view of the bag and the plate which is used to affix the floatation bags to the platform.

FIG. 6 is a section taken along line VI—VI as indicated in FIG. 5, a section of the locking plates.

FIG. 7 is a close-up view of the hinge structure of the platform.

FIG. 8 is a section along line VIII—VIII of the hinge structure of the platform as indicated in FIG. 7.

FIG. 9 is a section taken along line IX—IX of the end of the platform having the rescue ladder and showing the rotary connection.

DESCRIPTION OF THE PREFERRED EMBODIMENT

Figure 1:
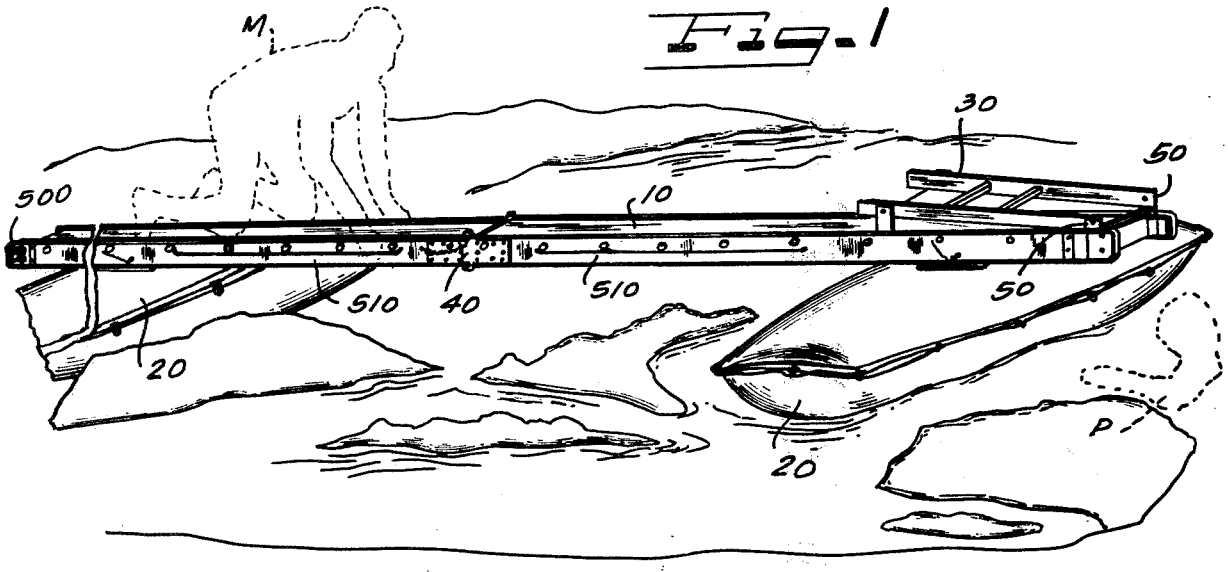
FIG. 1 is a view showing a rescuer crouched upon the rescue platform which is connected to the floatation bags which are floating in broken ice.

While the principles of the present invention find a particular utility in a lifesaving device, it will be understood that the floatation device arrangement of the present invention may be utilized in other combinations. By way of exemplary disclosure of the best mode of practicing the invention, there is shown generally in FIG. 1 a rescuer M, indicated by dashed lines, crouched upon the invention which is floating in broken ice toward a person P who has broken through the ice. With reference to FIG. 1, a platform 10 is supported by a pair of floatation bags 20 which are sealed and filled with a compressed gas. The platform 10 has a rescue ladder 30 affixed to one end thereof. As can be seen from FIG. 1, the apparatus is such that a rescuer M could safely sit or move about on the platform 10 in order to move the floatation apparatus closer to a victim in the water. The platform 10 has a hinge 40 which allows the structure to be folded up for easy transportation when not in use. The ladder 30 is pivoted at the pivot points 50 and may be dropped into the water or onto the ice as the person P to be rescued is approached. Normally as can be seen from FIG. 1 the ladder 30 is folded back onto the platform 10 out of the way until it is needed.

Figure 2:
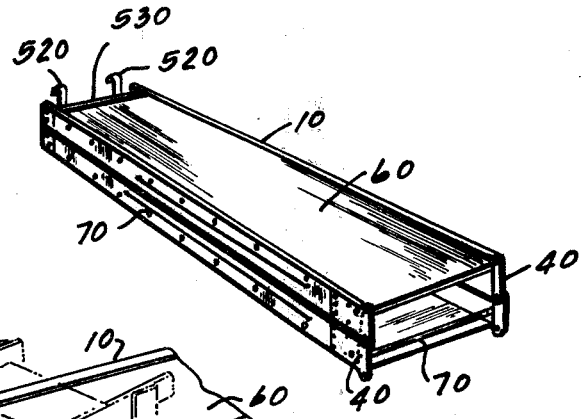
FIG. 2 is a view of the rescue apparatus as it is folded up for transportation.

FIG. 2 discloses the platform 10 folded at the hinge 40 as it would normally be folded for transportation. The length of the platform 10 in the folded condition is approximately 9 feet 3 inches. When opened its length is approximately 18 feet 6 inches. The platform 10 has a cover 60 upon which the rescuer and the rescued party actually stand or sit. The cover 60 is made out of any appropriate available materials such as plywood. FIG. 2 shows that there are two hinges 40, one on each side of the platform 10, which are used to enable a rescuer to fold the platform 10 for transportation purposes. The cover 60 of the platform 10 is covered with a non-skid epoxy. When the platform 10 is folded, the surface 60 becomes the top and the bottom of a transportation carton into which all of the other equipment including the floatation bags 20 is stowed until needed. The platform 10 has a set of reinforcing rungs 70 spaced along the platform 10 which support the cover 60.

Figure 3:
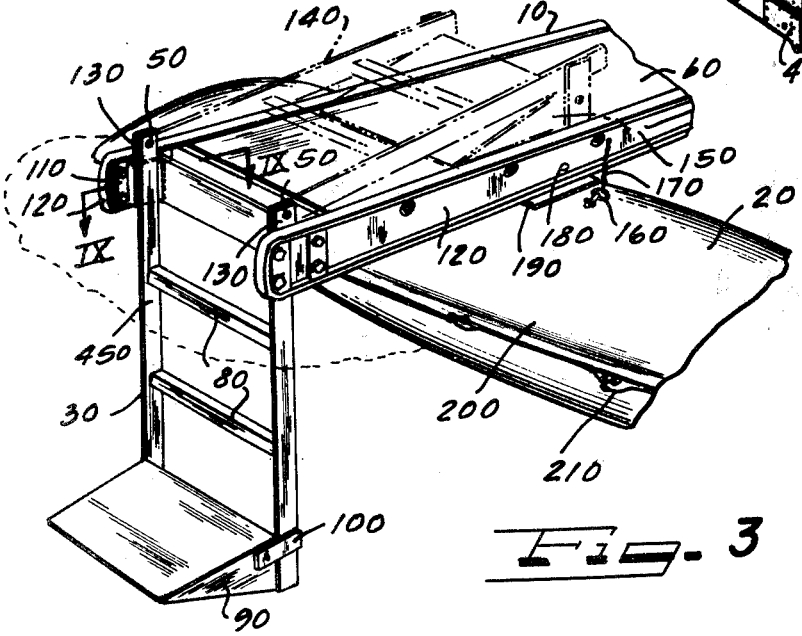
FIG. 3 is a view of one end of the rescue apparatus showing the rescue ladder in its folded and its operational positions.

FIG. 3 is a close-up view of the end of the platform 10 showing the inflatable floatation bag 20, the ladder 30, the pivot points for the ladder 50 and the cover 60. Each of the inflatable floatation bags 20 is approximately 8 feet long and 18 inches in diameter when inflated. Each of the inflatable floatation bags 20 has a volume of 13.25 cubic feet and is able to support, in the water, a weight of approximately 800 pounds. The gas pressure in the inflatable floatation bag 20 is anywhere between 3 to 5 pounds. The gas which is used is a standard carbon dioxide plus nitrogen mixture of a type used for inflating life rafts and other similar equipment. The material of the inflatable floatation bag 20 is Goodyear Type H 341 reinforced nylon or equivalent. In FIG. 3, the ladder 30, which is affixed to the platform 10 by the pivots 50, has rungs 80 suitable for standing on and a platform 90 rotatably mounted by a bracket 100 to the end of the ladder 30 which is opposite from the pivot points 50. As can be seen from FIG. 3, when the ladder 30 is in the operational position as shown, the platform 90 is beneath the surface of the water W or water-and-ice mixture. This facilitates easy access by the person being rescued. The platform 10, at the end where the ladder 30 is to be affixed, has two U-shaped slots 110 mounted to the two sides 120 of the platform 10. The two U-shaped slots 110 provide a bracket into which the end 130 of the ladder 30 may be easily inserted to support the ladder 30. The ladder 30 also has a non-operational position 140, shown in dash lines, which is the position the ladder 30 assumes until the floatation device approaches the person being rescued. When in the position 140, the platform 90 assumes the non-operational position 150 indicated by dash lines in FIG. 3 which assists in keeping the ladder 30 out of the rescuer's way. The inflatable floatation bag 20 is affixed to the platform 10 by a pair of pins 160 hanging from a pair of chains 170 on each side of the platform 10. The chains 170 are affixed to the platform 10. The pin 160 is plugged into an aperture 180 and matches an aperture in a right angle bracket attached to the plate 190 affixed to the inflatable floatation bag 20. The inflatable floatation bag 20, as can be seen, may thus be readily removed or affixed to the platform 10. The bag 20 also has a rope 200 affixed to it by means of fasteners 210 which provides an added grasping means onto which the rescued person may hang until they can ascend the ladder 30 and get out of the water.

FIG. 4 discloses the unfolded platform 10 before the equipment stowed therein which rests against the cover 60 has been removed and, in the case of the inflatable floatation bags 20, inflated. The inflatable floatation bags 20, are inflated by means of cylinders 220 either affixed to the inflatable floatation bags 20 or stowed along with the inflatable floatation bags 20 within the platform 10. Other lifesaving equipment which may be stored within the platform 10 includes a lifesaving ring 230, paddles 240 and life vests 250 for the rescuers to put on before departing from shore. To properly retain the stowed equipment within the platform 10, there is an end plate 260 at the end of the platform 10 to which the ladder 30 is affixed which serves to keep the stowed equipment from falling out the end of the platform 10 when it is in the closed condition.

FIG. 5 discloses the detailed structure of the plate 190 with respect to an inflatable floatation bag 20 and the platform 10. The plate 190 has associated with it a set of two bolts 270 and two bolts 272. These four bolts not only hold the plate 190 in position against the inflatable floatation bag 20 but also serve to hold a pair of right angle brackets 280 in position with respect to the plate 190. It is into an aperture 290 on each of the plates 280 that the locking pins 160 are inserted through the aperture 180 in the platform 10. The platform 10 is indicated in FIG. 5 by dashed lines and, as can be seen, an interior side 300 of each of the sides 120, shown by dashed lines, rests next to the right angle plate 280 and on the plate 190. The inflatable floatation bag 20 is inflated by means of a standard inflation valve 320 having a check valve and is deflated by a standard deflation bag 322.

FIG. 6 is a cross section taken along line VI—VI as indicated in FIG. 5. FIG. 6 illustrates the details of the plate 190 which mates with the right angle plate 280 which, in turn, mates with the inside 300 of the side of the frame 120 of the platform 10. An aluminum footer 324 is molded to the outside of the inflatable floatation bag 20 and provides an anchor for the two bolts 270. The aluminum footer 324 is covered by the piece of fabric 325 and its size is 3/16"×2"×17". The bolt 270 goes through a hole 327 large enough to accommodate the body of the bolt 270. The bolt 270 affixes the plate 190 above the footer 324 which is outside of the inflatable floatation bag 20. The right angle 280 rests upon the plate 190 and is held in position by the bolt 270 and the nut 275. The locking pin 160 holds the side 120 in position with respect to the right angle plate 280 with a spacer 282 therebetween. The two bolts 272 are anchored in a second aluminum footer 328 affixed to the inflatable floatation bag exactly as is the footer 324. The footer 328 is the same size as is the footer 324.

FIG. 7 is a close-up view of the hinge 40 one of which is on each of the sides 120 of the platform 10. The hinge 40 is bolted on to the side 120 by a set of bolts 350. The hinge 40 is locked into its open position as illustrated in FIG. 7, when the platform 10 is unfolded by a pin 350 of the same type as the pins 160 hold the inflatable floatation bags 20 to the frame 10. A chain 360 connects the pin 350 to a hook 370 of a standard variety affixed to the side 120 of the platform 10. The pin 350 is inserted into an aperture 380 through the two folding sections 400 and 410 of the platform 10 to lock those sections into their operational position.

FIG. 8 is a cross section taken along line VIII—VIII as indicated in FIG. 7 showing the detailed structure of the hinge 40. The bolts 350 affix the hinge 40 to the side 120 of the platform 10 by means of a plate 420. The hinge 40 has a pivot point 430.

FIG. 9 is a cross section taken along line IX—IX as indicated in FIG. 3. An end 440 of the side 120 of the platform 10 has bolted to it the bracket 110 and the end 260 of the platform 10 by a bolt 470 and a bolt 480. The bracket 110 provides a U-shaped support into which the flange 130 which is affixed to the ladder 30 at the pivot point 50, fits to support the ladder 30. The end 260 of the platform 10 also assists in supporting the flange 130 and holding it in proper position. The vertical portion 450 of the frame of the ladder 30 rests against the end 260 of the frame 10 when the ladder 30 is in its operational position.

Holes 500 are found at the ends of the platform 10 opposite the end with the ladder 30 to affix ropes to the platform 10 so that it might be pulled to shore once a rescue has been completed. Further, a small outboard motor could be mounted on one end of the platform 10 to minimize the need to paddle. Ropes 570 are affixed to the sides 120 of the platform 10 to provide a support means to a person to be rescued. Aluminum hooks 520 are affixed to the end rung 530 at the end of the platform 10 opposite the end where the ladder 30 is affixed. The hooks 520 are suitable for connecting to the rungs of a standard fire department 50' ladder so the platform 10 may be extended onto thin ice from shore.

Although various modifications might be suggested by those skilled in the art, it should be understood that I wish to embody within the scope of the patent warranted hereon all such modifications as reasonably and properly come within the scope of my contribution to the art.

I claim as my invention:

1. A lifesaving device for use on ice or in water comprising:

a platform;

a plurality of inflatable floatation devices each having means for inflation;

each member of said plurality of inflation devices having means for removably affixing said member to said platform such that said platform will be held out of a water or ice einvironment when said floatation devices are placed therein and such that said inflatable floatation devices may be removed from said platform, said means for removably affixing including a plate fixedly attached to each said member of said plurality, each said plate having fixedly attached thereto a right angle member with a first and a second portion substantially perpendicular to one another with said first portion being positioned substantially adjacent to and selectively located with respect to said plate;

said platform having a surface selectively located adjacent said second portion of said right angle member with said platform surface and said second portion each having a hole therethrough, selectively located thereon so that a removable means for linking said platform surface and said second portion rigidly together might be inserted therethrough.

2. A lifesaving device according to claim 1 having additionally a ladder rotatably mounted by a first end at one end of said platform; said ladder being rotatable into a first position until needed and rotatable into a second position so that a second end of said ladder is beneath the water upon which said inflatable floatation devices are floating or lies upon the ice upon which said inflatable devices are resting.

3. An improved lifesaving device for use on ice or water having an elongated platform and a pair of elongated inflatable floatation devices removably affixed to the platform with the axis of each elongated floatation device located essentially perpendicular to the elongated platform, the improvement comprising:

improved means for removably affixing each inflatable floatation device to the platform, said means including one or more plates molded into each floatation device, said plate having affixed thereto at least one right angle member having a boring selectively located thereon through which extends a removable locking means operatively connectable to means integral with said platform whereby each floatation device is removably, and rigidly attached to said platform.

4. A lifesaving device comprising a pair of inflatable floatation bags;

a platform;

a ladder rotatably mounted at one end of said platform; said inflatable floatation bags having substantially a cylindrical shape and each said bag having means for removably affixing each said bag to said platform with the axis of rotation of said substantially cylindrical inflation bags being perpendicular to the length of said platform; said inflatable floatation bags having adequate buoyancy to support said hinged platform bearing several rescuers thereon upon an ice surface or floating upon a water or water-and-ice mixture said means for removably affixing including a plate molded into each said bag with a right angle member operably attached thereto;

said platform having a boring selectively located therethrough through which extends a means for rigidly affixing said platform to said right angle member.

5. The lifesaving device according to claim 4, wherein said rotatably mountable ladder has a first end rotatably affixed to one end of said platform and a second end having a safety platform affixed thereto such that said safety platform affixed to said second end of said ladder extends beneath the surface of the water when said ladder is rotated so as to be substantially perpendicular to said platform.

6. The lifesaving device according to claim 5, wherein said platform includes a storage compartment for said inflatable floatation bags when said inflatable floatation bags are not inflated.

7. The lifesaving device according to claim 5 having valve means associated with each of said inflatable floatation bags for inflation by means of a compressed gas.

8. A lifesaving device comprising:

a pair of inflatable floatation bags;

a hinged platform;

a ladder rotatably mounted at one end of said hinged platform; said inflatable floatation bags having substantially a cylindrical shape and being removably mountable to said hinged platform with the axis of rotation of said substantially cylindrical inflation bags being perpendicular to the length of said hinged platform; said inflatable floatation bags having adequate buoyancy to support said hinged platform bearing several rescuers thereon upon an ice surface or floating upon a water or water-and-ice mixture;

wherein said rotatably mountable ladder has a first end rotatably affixed to one end of said hinged platform and a second end having a safety platform affixed thereon such that said safety platform affixed to said second end of said ladder extends beneath the surface of the water when said ladder is rotated so as to be substantially perpendicular to said platform; having further valve means associated with each of said inflatable floatation bags for inflation by means of compressed gas;

wherein each of said inflatable floatation bags is removably affixed to said hinged platform by means of a first plate molded into said each of said inflatable floatation bags, having a second plate mounted on said first plate, having a set of right angles operably connected to said second plate which is mounted on said first plate; said set of right angles being removably connected to said hinged platform.

9. The lifesaving device according to claim 8 having further valve means associated with each of said inflatable floatation bags for deflation thereof.

10. A lifesaving device for use on ice or in water comprising:

a platform;

a plurality of inflatable floatation devices each having means for inflation and deflation;

said platform being removably affixed to said inflatable floatation devices such that said platform will be held out of a water or ice environment when said floatation devices are placed therein with said platform mounted thereon;

said means for removably affixing including a plate fixedly attached to each said member of said plurality, each said plate having a right angle member with a first and a second portion substantially perpendicular to one another with said portion being positioned substantially adjacent to and selectively located with respect to said plate, said first portion of said right angle member being fixedly attached to said plate; said platform having a surface locatable adjacent said second portion of said right angle member with said platform surface and said second portion each having a boring therethrough, and selectively located thereon, so that a removable means for linking said platform surface and said second portion rigidly together might be inserted therethrough.

11. The lifesaving device according to claim 10 wherein said platform is an elongated platform.

* * * * *

UNITED STATES PATENT AND TRADEMARK OFFICE

CERTIFICATE OF CORRECTION

PATENT NO. : 4,179,764

DATED : December 25, 1979

INVENTOR(S) : Roy W. Lindblade

It is certified that error appears in the above-identified patent and that said Letters Patent are hereby corrected as shown below:

Column 5, line 2, cancel "einvironment", and substitute --environment--.

Signed and Sealed this

*Twenty-sixth* Day of *August 1980*

[SEAL]

*Attest:*

SIDNEY A. DIAMOND

*Attesting Officer*

*Commissioner of Patents and Trademarks*